United States Patent [19]

Kinser

[11] Patent Number: 4,672,873

[45] Date of Patent: Jun. 16, 1987

[54] CHEESE CUTTER APPARATUS

[76] Inventor: Robert E. Kinser, 5717 E. 75th, Hutchinson, Kans. 67502

[21] Appl. No.: 849,257

[22] Filed: Apr. 4, 1986

[51] Int. Cl.[4] ..... B26D 1/547

[52] U.S. Cl. ..... 83/200.1; 83/651.1

[58] Field of Search ..... 83/200.1, 651.1

[56] References Cited

U.S. PATENT DOCUMENTS

| | | | |
|---|---|---|---|
| 2,073,257 | 3/1937 | Van Riper | 83/651.1 X |
| 2,158,667 | 5/1939 | Rieck et al. | 83/651.1 X |
| 2,443,928 | 6/1948 | Passarelli | 83/651.1 X |
| 3,821,916 | 7/1974 | Ricci et al. | 83/200.1 |
| 4,599,928 | 7/1986 | Oker | 83/651.1 X |

*Primary Examiner*—Donald R. Schran

*Attorney, Agent, or Firm*—Phillip A. Rein

[57] ABSTRACT

This invention relates to a cutter apparatus operable to slice a block of cheese or other foodstuffs having a main support assembly with a cutter means mounted thereon. The main support assembly is provided with a rectangular box type structure having an upper top support plate to receive the foodstuffs thereon for a cutting operation. The cutter means includes a plurality, namely four (4), cutter actuator assembly. Each cutter actuator assembly includes a cutter assembly interconnected to a retractable filament assembly. Each cutter assembly includes a cutter filament member connected to an actuator handle member with the filament member being adapted to be pulled laterally from the main support assembly due to the retractable filament assembly. The retractable filament assembly is additionally operable on release of an actuator lever member to provide a biasing force to hold the cutter filament member in an extended position or selectively retract the same within the main support assembly. The cutter filament members are adapted to be placed across the top support plate before the foodstuff is placed thereon for a subsequent upward cutting operation of the cutter filament members through the foodstuff to slice same into a plurality of substantially equal pieces.

11 Claims, 7 Drawing Figures

FIG. 1
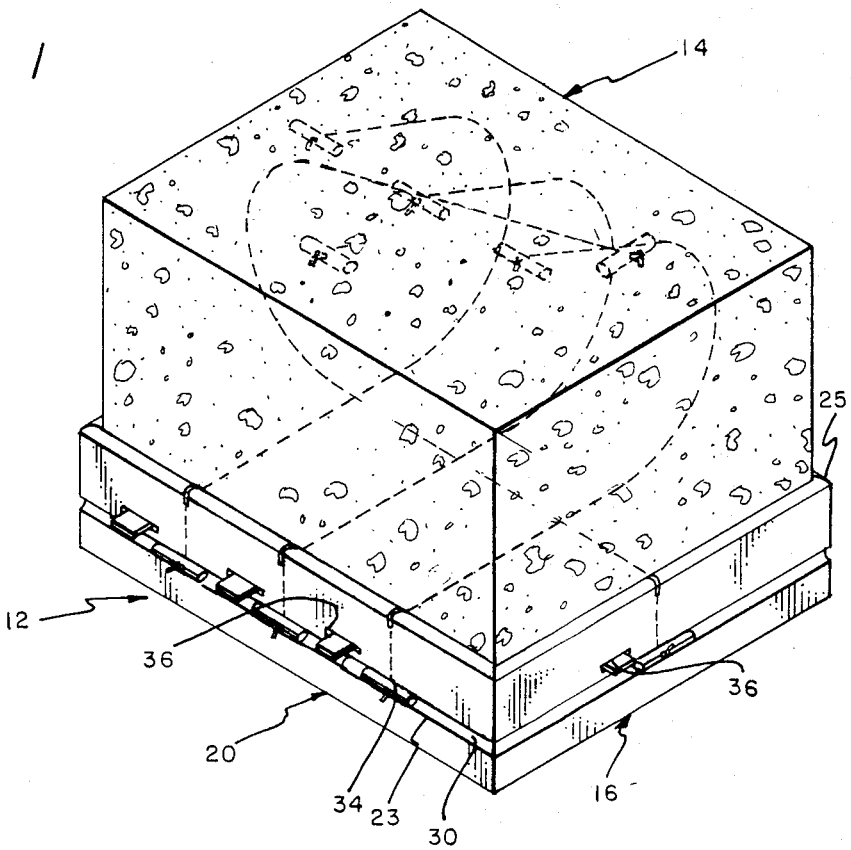
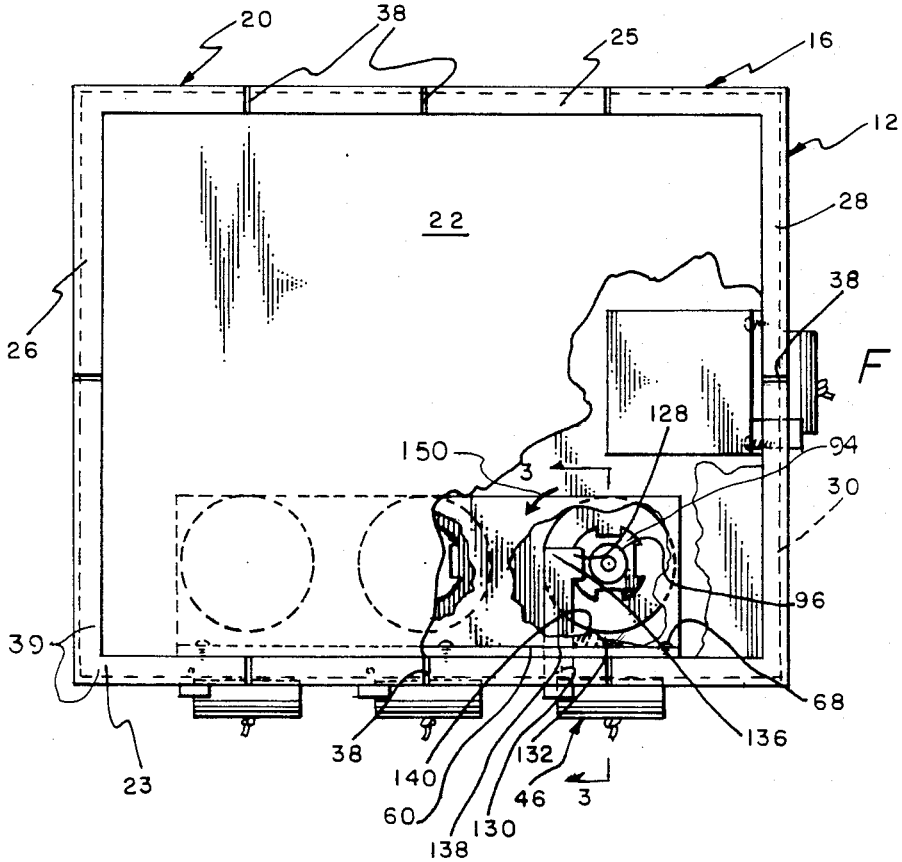
FIG. 2

CHEESE CUTTER APPARATUS

The Howell patent discloses the use of a handle and flexible wire structure to slice a block of cheese held within a container type dispenser apparatus.

The Perry patent discloses a rigid wire structure to slice soap and uses a lever principle to move the wire downwardly through a block soap structure.

The Taylor patent discloses a cheese slicer whereupon a block of cheese is moved through a stationary wire member.

The Mueller patent discloses a cheese cutter having a rigid frame structure with a plurality of cutter wires. The cheese cutter is operable similar to an ink stamp member as the plurality wires are moved through a cheese member to slice same. The novelty in this invention appears to be the means for independently attaching respective wire members to the support frame.

The Tapparo patent discloses a large cheese member to be sliced by a flexible wire member and having a geared, hand operated power structure for moving the wire downwardly through the stationary cheese member.

The Mayer patent is pertinent in that it discloses a method of laying a large block or wheel of cheese on a flexible wire having a handle member connected thereto. Then, the wheel of cheese is sliced by moving the wire upwardly through the stationary cheese member.

It is noted that none of the above noted patent references utilize a high strength filament member which is very flexible and easily adapted to be pulled upwardly through a stationary block of cheese or other foodstuffs in a manner to be disclosed by the applicant's invention set forth herein.

PREFERRED EMBODIMENT OF THE INVENTION

In one preferred embodiment of this invention, a cheese cutter apparatus is disclosed having (1) a main support assembly; and (2) a plurality of cutter actuator assemblies connected to the main support assembly and operable to cut a large block of cheese into multiple pieces such as eight (8) substantially equal sizes. The main support assembly includes a rectangular support wall assembly having a top plate mounted on an upper side thereof and a bottom enclosure plate on the lower side thereof to enclose the cutter actuator assemblies. The support wall assembly includes opposed wall members having alignment notches in upper edges thereof to receive and align portions of the cutter actuator assemblies therein. The cutter actuator assemblies in this embodiment includes three (3) thereof along a front wall member and one (1) along one side wall member. Each cutter actuator assembly includes a cutter assembly with a retractable filament assembly connected thereto. Each cutter assembly includes an elongated cutter filament member having one end attached to an actuator handle member and trained through a filament wear and guide member mounted in the support wall assembly and having the other end thereof connected to a respective retractable filament assembly. Each retractable filament assembly includes a main support reel mounted on a support base member and operable through a ratchet assembly to act as a retractable filament member take-up structure. More particularly, the cutter filament member is mounted about the main support reel and operable through the ratchet assembly to allow the same to be pulled outwardly to a usage condition. The ratchet assembly is operable to selectively rotate the main support reel and retract the interconnected cutter assembly into a compact, hidden retracted position within the main support assembly.

OBJECT OF THIS INVENTION

One object of this invention is to provide a cheese cutter apparatus having a plurality of cutter actuator assemblies connected to a main support assembly and operable to place cutter assemblies underneath a block of cheese and pull the cutter assemblies upwardly through the stationary block of cheese in order to achieve a cutting function thereon.

One other object of this invention is to provide a cheese cutter apparatus having a plurality of cutter assemblies having retractable cutter filament members which are sufficient in strength and flexibility to achieve a clean slicing of a block of cheese without the danger of injury to the operator thereof.

Still, one other object of this invention is to provide a cutter apparatus operable to slice foodstuffs using an efficient, effective, and safe means with elongated filament cutter members whereupon it is easy to use, simple to operate, safe in usage, plus easily cleansed and maintained.

Still, one further object of this invention is to provide a cheese cutter apparatus having a main support assembly with cutter actuator assemblies mounted herein having a plurality of retractable cutter assemblies with cutter filament members which are moved from an extended usage position to a retracted, storage and containment position within the main support assembly.

Another object of this invention is to provide a cutter apparatus operable on foodstuffs to provide fast, clean cutting thereof which with structure being economical to manufacture, reliable in usage, substantially maintenance free, and easy to maintain with replacable cutter filament members.

Various other objects, advantages, and features of the invention will become apparent to those skilled in the art from the following discussion, taken in conjunction with the accompanying drawings, in which:

FIGURES OF THE INVENTION

FIG. 1 is a perspective view of a chesse cutter apparatus of this invention illustrated as having a large chunk of cheese mounted thereon with cutter filament members shown in a cutting operation in dotted lines.

FIG. 2 is a top plan view of the cheese cutter apparatus of this invention having portions thereof broken away for clarity;

Figure 4:
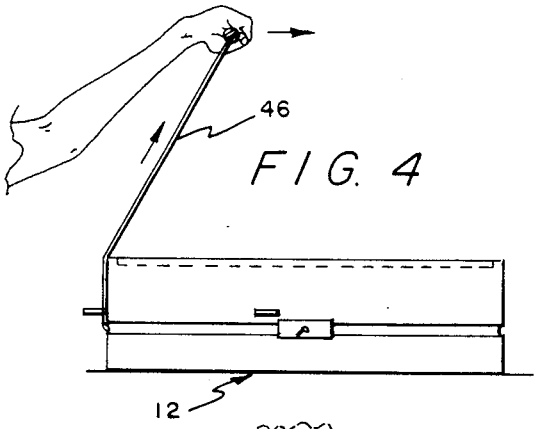
Figure 5:
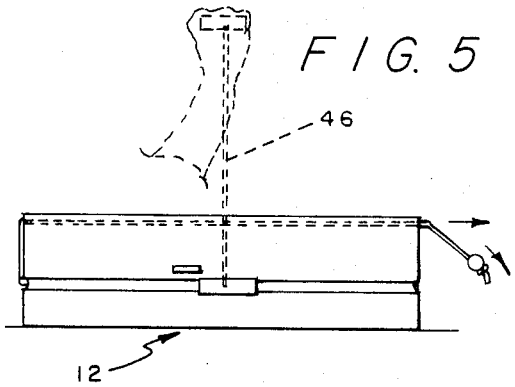
Figure 6:
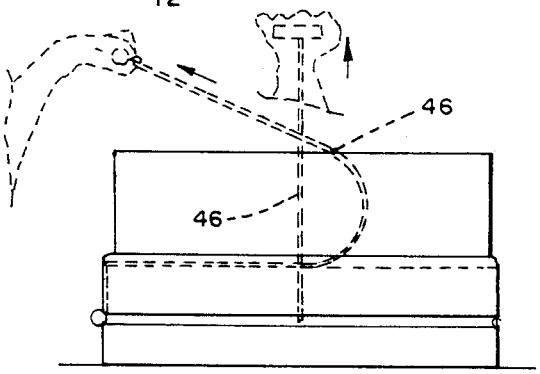
Figure 7:
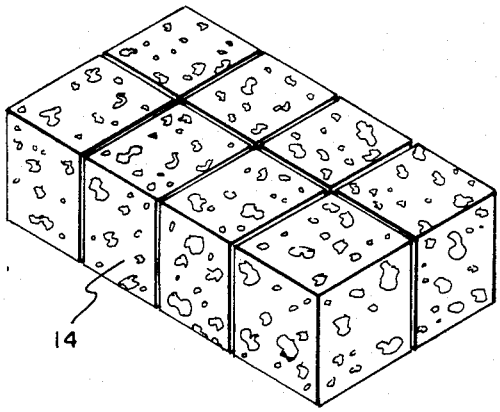

FIG. 4, 5, and 6 are side elevational views illustrating the use of cutter assemblies for positioning the elongated cutter filament members underneath a block of cheese thereon as noted in FIG. 6 for the subsequent cutting operation; and FIG. 7 is a perspective view showing a block of cheese having been cut into eight (8) approximately equal pieces.

The following is a discussion and description of preferred specific embodiments of the new cheese cutter apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

On referring to the drawings in detail and, in particular to FIG. 1, a cheese cutter apparatus of this invention, indicated generally at 12, is shown as having a block of cheese 14 mounted thereon prior to performing the function of slicing same as will be explained in detail. The block of cheese 14 to be cut by the cheese cutter apparatus 12 of this invention is normally of a large size such as a forty (40) pound block which is sliced into for example, eight (8) approximately equal sizes (FIG. 7) before being inserted into a cheese shredding apparatus. This cheese cutter apparatus 12 of this invention is normally utilized in restaurants and commercial operations but it is obvious that the invention can be constructed of smaller size for home use.

The cheese cutter apparatus 12 utilizes a main support assembly 16 and a plurality, namely four (4) in this embodiment, of cutter actuator assemblies 18 connected to the main support assembly 16.

The main support assembly 16 is of a generally rectangular or box shape having (1) a main support wall assembly 20 providing vertical, upright support thereto; (2) a top wall plate 22 connected to an upper edge portion of the support wall assembly 20; and (3) a bottom enclosure plate 24 interconnected to a lower under portion of the support wall assembly 20 as will be noted.

The main support wall assembly 20 includes a front wall member 23; a back wall member 25; and opposed side wall members 26, 28 to interconnect the front wall member 23 and the back wall member 25. Each of the aforementioned wall members are substantially identical in configuration and form the vertical support periphery of the cheese cutter apparatus 12 of this invention.

Each of the wall members 23, 25, 26, and 28 are provided with a handle groove 30 about an outer periphery thereof; a top plate groove 32 to receive the top support plate 22 therein; and a bottom plate notch 33 adapted to receive the bottom enclosure plate 24 therein and secured thereto as will be noted.

Additionally, the front wall member 23 and the one side wall member 28 are provided with cutter openings 34 and adjacent respective actuator slots 36 therein to receive a portion of the cutter actuator assemblies 18 therethrough. Additionally, the front wall member 23 and back wall member 25 have three (3) aligned notches 38 in an upper surface 39. The opposed side wall members 26 and 28 are provided with the similar upper aligned notches 38 in an upper surface 39 to receive a portion of the cutter actuator assemblies 18 as will be explained.

The top support plate 22 provides a hard and easy to clean surface such as formica or the like as receives the foodstuffs, namely, a block of cheese 14, thereon although no cutting action is taken thereagainst. It is constructed for attractive appearance and ease of maintenance.

The bottom enclosure plate 24 is merely a cover plate and is provided with a plurality, preferably four (4), connector holes 42 in each corner having a respective anchor screw 44 extended therethrough to provide an attractive appearing closure to the support wall assembly 20. The anchor screws 44 are removed to disconnect the bottom enclosure plate 24 for repair and maintenance on the cutter means 17 as may be required.

The cutter means 17 includes a plurality, namely four (4), of cutter actuator assemblies 18 which operate independently but cooperate in the overall use and method of this invention to achieve the new and novel foodstuff cutting process as will be noted. It is seen that three (3) of the cutter actuator assemblies 18 are mounted along an interior surface of the front wall member 23 and one of the cutter actuator assemblies 18 is mounted on an interior surface of the side wall member 28, all within the enclosure of the main support assembly 16.

Each cutter actuator assembly 18 includes a cutter assembly 46 which is operably connected to a retractable filament assembly 48. Each ccutter assembly 46 includes an elongated flexible cutter filament member 52; an actuator handle member 54 connected as through a knot feature to one end of the cutter filament member 52; and a filament wear and guide member 56 which is mounted through respective ones of the cutter openings 34 in the front wall member 23 and the side wall member 28. The filament wear and guide member 56 can be constructed of a lubricating type material such as teflon and being adapted to both guide and control wear of the cutter filament member 52 as it is moved axially therethrough from storage to extended positions.

Each retractable filament assembly 48 includes (1) a pulley support bracket 62; (2) a main support reel 64 rotatably connected to the pulley support bracket 62; and (3) a ratchet assembly 66 interconnected between the pulley support bracket 62 and the main support reel 64. Additionally, the retractable filament assemblies 48 which are connected to the front wall member 23 are interconnected to a common elongated plate or support base member 60 and secured by anchor members 68 to the front wall member 23 as noted in FIG. 2.

Each pulley support bracket 62 includes a u-shaped support member 70 have a main section 72 with integral support legs sections 74. The main support reels 64 are mounted between the leg sections 74 and rotatably mounted within aligned connector holes 76.

Each main support reel 64 includes a reel housing 78 connected by a connector assembly 80 to the pulley support bracket 62. The reel housing 78 includes (1) outer hub members 82; (2) end wall members 84 integral with respective ones of the hub members 82; and (3) a central body section 86 mounted between the parallel, spaced end wall members 84.

The hub members 82 includes (1) an upper hub section 88; and 2) a lower hub section 90. The upper lock hub section 88 is provided with a central opening 92 and an integral ratchet plate 94. The ratchet plate 94, as best shown in FIG. 2, is provided with a plurality, namely four (4), ratchet notches 96 therein for use with the ratchet assembly 66 as will be explained.

The lower hub section 90 is provided with a central opening 92 as described for that of the upper hub section 88 for use as will be noted.

The end wall members 84 consists of circular plate members 98 with bottom one thereof provided with a plurality of connector holes 99 to receive screw members 100 therein for anchoring same to the central body section 86.

The central body section 86 resembles a cylindrical tube section having an inner cylindrical cavity 101 and an outer support surface 103 to receive and support a filament member thereon similar to that of a fishing reel structure with fish line wound thereon. The connector assemblies 80 includes (1) a hub connector assembly 105; (2) bearing members 107; and (3) an anchor shaft 110. The anchor shaft 110 is held by the hub connector assemblies 105 while permitting the reel housing 78 to rotate in the bearing members 107. More particularly, the hub connector assemblies 105 each includes (1) washer members 112 mounted on outer opposed walls of the support leg section 74 of the u-shaped support member 70; and (2) connector screws 114 extended therethrough to secure same to the anchor shaft 110.

The bearing members 107 each have an outer flange plate 116 integral with a central bearing cylinder 118. The flange plate 116 and bearing cylinders 118 are adapted to contact surfaces between the stationary anchor shaft 110 and the rotatable main support reel 64 for ease of rotation and proper operation thereof.

The anchor shaft 110 is provided with (1) connector holes 120 on opposite ends thereof so as to be anchored by the respective connector screws 114; and (2) having a laterally extended connector lug 122. The connector lug 122 resembles a small shaft or projection extended laterally of the anchor shaft 110 to receive a portion of the ratchet assembly 66 thereon as will be explained.

Each ratchet assembly 66 includes (1) a ratchet lever assembly 124 pivotally mounted within either the front wall member 23 or the side wall member 28 and (2) an actuator bias member 126 to provide proper operation of the main support reel 64 in a manner to be explained.

The ratchet lever assembly 124 includes (1) a ratchet lever member 128 rotatably mounted on a respective pivot post member 130 to the respective front wall member 23 or the side wall member 28; and (2) a bias member 132 interconnected between the wall members 23, 28 and the ratchet lever members 128. Each ratchet lever member 128 is composed of an L-shaped main body 134 having a lock section 136 integral with a handle section 138. The lock sections 136 are adapted to be received within a respective one of the ratchet notches 96 in the ratchet plates 94.

Figure 3:
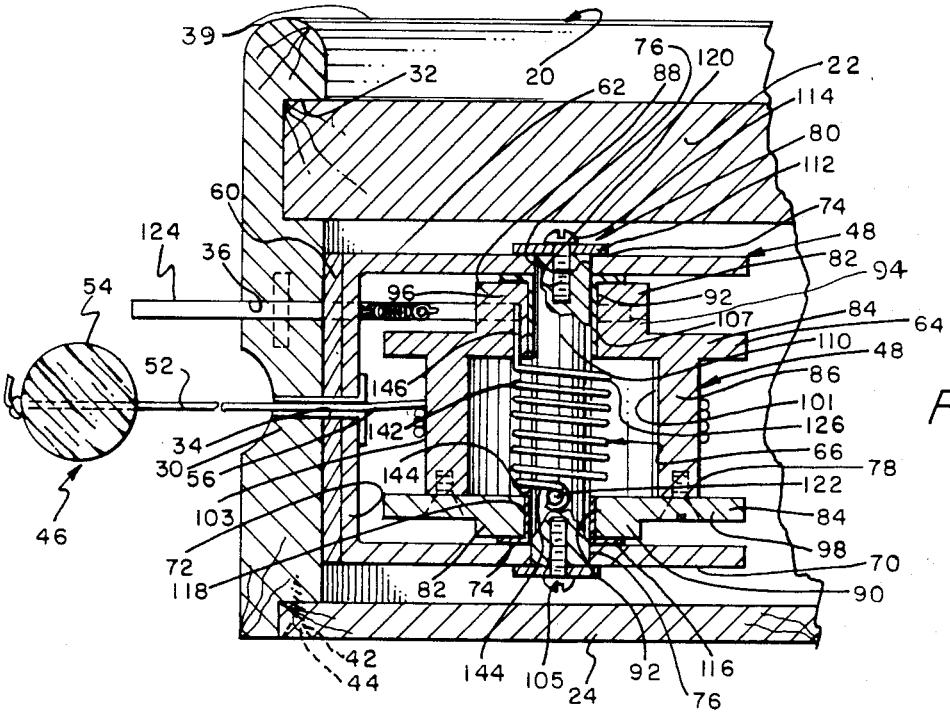
FIG. 3 is an enlarged sectional view taken along line 3—3 in FIG. 2.

It is noted in FIGS. 2 and 3 that the handle section 134 extends out respective ones of the actuator slots 36 in the respective wall members 23 and 28. The ratchet lever members 128 are adapted to be pivoted about the respective pivot post members 130 to move the respective lock sections 136 out of engagement with the ratchet notches 96 for a retracting operation of the cutter filament members 52 as will be explained.

The bias members 132 are tension spring members 140 which act to bias the respective ratchet lever members 128 into the locked or latched condition as shown in FIG. 2.

The actuator biasing members 126 are composed of coiled spring members 142 which are mounted about respective ones of the anchor shafts 110 as shown in FIG. 3. Each coiled spring member 142 is provided with a central portion with (1) an outer stationary connector section 144 connected to the connector lugs 122 on respective anchor shafts 110; and (2) an outer movable connector section 146 which is mounted within a slot in the upper hub section 88, on rotation of the reel housing 78 in one direction as shown by arrow 150 in FIG. 2, this operates to wind-up the the coiled spring member 142 which provides the power in the retraction process of the cutter filament members 152 as will be explained.

USE AND OPERATION OF THE INVENTION

In the use and operation of the cheese cutter apparatus 12 of this invention, the structure is first presented in the non-use condition as shown in FIG. 2 whereupon the cutter assemblies 46 are all in the retracted conditions. The first step on proceeding with a cheese cutting operation as noted in FIG. 4 is to grasp the actuator handle members 54 of the cutter actuator assemblies 18 mounted against the front wall member 23 and pull them outwardly into a desired length of the cutter filament members 52 have been exposed. The cutter filament members 52 will extend across the full length of the opposed side wall members 26, 28 and placed across the top support plate 22 as noted in FIG. 5. At this time, the cutter filament members 52 of the front cutter actuator assemblies 18 are placed so as to lay in the respective aligned notches 38 in the front wall member 23 and the back wall member 25.

Next, as noted in FIG. 5 in dotted lines, the actuator handle member 54 in the cutter assembly 46 mounted against the side wall member 28 is pulled outwardly into a sufficient length of the cutter filament member 52. This exposed length is greater than the length of the front wall member 23 and back wall member 25. As previously described for the other cutter assemblies 46, this cutter filament member 52 is placed within the aligned notches 38 in the upper surface 39 of the opposed side wall members 26, 28.

At this time, a large block of cheese 14 is mounted on the top support plate 22 of the main support assembly 16 having the four (4) cutter filament members 52 thereunder prior to a cheese cutting operation. In the cheese cutting operation as best noted in FIG. 6, the operator reaches across and grasps the actuator handle member 54 lying adjacent the side wall member 26 and pulls the same upwardly which achieves a cutting function with the cutter filament member 52. This operation is also shown in dotted lines in FIG. 1.

Next, the operator grasps one at a time the respective three (3) actuator handle members 54 adjacent the back wall member 25 and pulls the same upwardly as shown in dotted lines in FIGS. 1 and 6. After the cutting operation, the block of cheese member 14 is separated into eight (8) substantially equal pieces as noted in FIG. 7. This cutting operation achieves a very clean cutting surface with a minimum amount of debris and waste achieved therefrom. The cutter filament members 52 act like very sharp knife blades but functions better than the normal knife blade operation.

The cutter filament members 52 are preferrably of a flexible plastic fishing line type of 50 to 100 pound test weight. Most preferred is a 50 pound mono-filament line known as "STREN" manufactured by E. I. Du Pont De Nemours and Company. "STREN" is a trademark owned by the Du Pont Company.

It is seen that the cutter apparatus of this invention is shown and illustrated as used on a large block of cheese but, of course, it could be used on other food products such as bologna, soap, or the like. The cutter assemblies are readily retractable within the main support assembly so as to utilize a minimum amount of space in a compact structure not requiring exterior knives and skill in usage thereof.

The cutter apparatus of this invention is easy to operate requiring a minimum amount of skill to do so. Additionally, the cutter apparatus presents a substantial improvement in safety features over the prior art method of utilizing a knife which, in addition to being very dangerous, is a time consuming operation, while the cutter apparatus of this invention is very fast and economical to use. Additionally, the cheese cutter apparatus includes the cutter assemblies having the cutter filament members constructed of a mono-filament such as 50 to 100 pound test line similar to that used in fishing operations and, therefore, the cutter filament members can be easily obtained and replaced on the respective main support reels as deemed necessary.

The cheese cutter apparatus of this invention is attractive in appearance; easy to operate; sturdy in construction; easy to clean and maintain; and safe in usage.

While this invention has been described in conjunction with preferred specific embodiments, it will be understood that this description is intended to illustrate and not to limit the scope of the invention, which is defined by the following claims.

I claim:

1. A cutter apparatus operable to slice foodstuff products, comprising:

(a) a main support assembly;

(b) a cutter means connected to said main support assembly including a cutter actuator assembly;

(c) said cutter actuator assemblyincluding a cutter assembly connected to one side of said main support assembly and having an actuator handle member connected to one end of a cutter filament member;

(d) said cutter filament member is placed across a top surface of said main support assembly before the foodstuff is placed thereon;

(e) said actuator handle member is grasped to pull said cutter filament member upwardly and through the food product for a cutting operation;

(f) said cutter actuator assembly includes a retractable filament assembly mounted on said main support assembly under said top surface and connected to said cutter filament member; and (g) said retractable filament assembly connected to another end of said cutter filament member is operable to retract same into said main support assembly under said top surface when in a storage or inoperative condition.

2. A cutter apparatus as described in claim 1, wherein:

(a) said main support assembly includes a support wall assembly having front, back, and side wall members;

(b) a top peripheral surface of said support wall assembly having pairs of spaced aligned notches to receive portions of said cutter filament member therein to hold in proper alignment for cutting in a vertical plane of the food product mounted on said main support assembly; and (c) said retractable filament assembly includes a rotatable main support reel having said cutter filament member mounted thereon and operable with a ratchet assembly to hold said cutter filament member against axial movement in either direction when in an outward extended position for a cutting operation.

3. A cutter apparatus as described in claim 1, wherein:

(a) said retractable filament assembly including a pulley support bracket; a main support reel rotatably mounted on said support bracket; and a ratchet assembly operably connected to said pulley support bracket and said main support reel;

(b) said ratchet assembly having a biasing member connected to said main support reel and said pulley support bracket to bias said main support reel toward a retracted condition whereupon release of the tension of said biasing member operates to retract said cutter filament member on said main support reel to pull same within said main support assembly to a non-use and retracted position; and (c) said ratchet assembly includes a ratchet lever assembly pivotally connected to said main support assembly and engagable with said main support reel under force of said biasing member to prevent rotation thereof and movement of said cutter filament member.

4. A cutter apparatus as described in claim 3, wherein:

(a) said main support assembly includes a support wall assembly having front, back, and opposed side wall members; and (b) said front wall member and said back wall members or opposed ones of said side wall members having a cutter opening therein to receive said cutter filament member therethrough and an actuator slot adjacent said cutter opening to receive a portion of said ratchet lever assembly therethrough for selective movement out of engagement with said main support reel for rotational movement thereof to the retracted position.

5. A cutter apparatus as described in claim 1, wherein:

(a) said cutter means includes a plurality of said cutter actuator assemblies each having one of said cutter assemblies;

(b) more than one of said cutter assemblies connected to said one side of said main support assembly;

(c) said cutter assemblies each having one of said cutter filament members placed across said top surface of said main support assembly; and (d) said cutter filament members selectively and independently pulled upwardly through the foodstuff to achieve the cutting operation with the foodstuff sliced into a plurality of pieces such as halves, fourths, or eights.

6. A cutter apparatus as described in claim 5, wherein:

(a) said main support assembly includes a support wall assembly having front, back, and opposed side wall members;

(b) three (3) of said cutter assemblies mounted against said front wall member and one of said cutter assemblies mounted against one of said side wall members;

(c) said cutter assemblies individually and independently usable to pull respective ones of said cutter filament members through the foodstuff; and whereby the foodstuff is selectively sliced into substantially equal pieces.

7. A cutter apparatus operable to achieve a cutting, slicing operation of large foodstuffs products, comprising:

(a) a main support assembly being of a rectangular box shape having an upper top support plate to receive the foodstuff thereon;

(b) a cutter means having a plurality of cutter actuator assemblies operable to slice the food products;

(c) said cutter actuator assemblies each having a cutter assembly connected to a retractable filament assembly;

(d) each of said cutter assemblies having a cutter filament member movable laterally of said main support wall assembly and extended over and supported on said top support plate just prior to a cutting operation;

(e) said cutter filament members mounted within aligned slots in a top surface of said main support assembly so as to hold the same in proper parallel relationships and/or perpendicular relationship to each other just prior to a cutting operation;

(f) each of said retractable filament assembly includes a pulley support bracket and a ratchet assembly;

(g) a main support reel rotatably mounted in said pulley support bracket;

(h) said rachet assembly includes a ratchet lever assembly pivotally connected to said main support assembly and engagable with said main support reel under force of said biasing member to prevent rotation thereof;

(i) said ratchet assembly having an actuator bias member to contact said main support reel so as to bias same towards retraction; and (j) on release of said main support reel through said ratchet assembly, said actuator bias member operates to rotate said main support reel to retract said cutter filament member thereon to the non-use storage condition.

8. A cutter apparatus as described in claim 1, wherein:

(a) said cutter filament member releasably connected to said actuator handle member and being of a substantial length, whereby said cutter filament member can be severed and a severed outer end thereof reconnected to said actuator handle member to present an unused portion of said cutter filament member across said top surface of said main support surface for further cutting operations.

9. A cutter apparatus as described in claim 7, wherein;

(a) said cutter filament members releasably connected to said actuator handle members and each being of substantial lengths whereby said cutter filament members can be severed and the respective severed outer ends thereof reconnected to said actuator handle members to present unused portions of said cutter filament member across said top surface of said main support surface for further cutting operations.

10. A cutter apparatus as described in claim 1, wherein:

(a) said main support assembly includes a handle groove in a peripheral outer surface thereof to hold said actuator handle member therein when in the non-usage, retracted, condition.

11. A cutter apparatus as described in claim 7, wherein:

(a) said main support assembly includes handle grooves in peripheral outer surfaces thereof to hold said actuator handle members therein when in the non-usage, retracted, condition.

* * * * *